US007775946B2

(12) United States Patent
Parviainen

(10) Patent No.: US 7,775,946 B2
(45) Date of Patent: Aug. 17, 2010

(54) MULTIFUNCTIONAL TRAINER FOR STRENGTH TRAINING

(75) Inventor: Arno Parviainen, London (GB)

(73) Assignee: Adam Sports Finland Oy, Helsinki (FI)

( * ) Notice: Subject to any disclaimer, the term of this patent is extended or adjusted under 35 U.S.C. 154(b) by 35 days.

(21) Appl. No.: 11/799,813

(22) Filed: May 2, 2007

(65) Prior Publication Data

US 2007/0275836 A1 Nov. 29, 2007

(30) Foreign Application Priority Data

May 2, 2006 (FI) ..... 20060424

(51) Int. Cl.
*A63B 21/00* (2006.01)
*A63B 21/062* (2006.01)

(52) U.S. Cl. ..... 482/100; 482/92; 482/138

(58) Field of Classification Search ..... 482/92–96, 482/98, 101, 100, 133–138, 99, 102, 103, 482/97

See application file for complete search history.

(56) References Cited

U.S. PATENT DOCUMENTS 4,311,305 A * 1/1982 Lambert et al. ..... 482/137
4,511,137 A * 4/1985 Jones ..... 482/100
4,730,829 A 3/1988 Carlson
5,098,088 A 3/1992 Cohen et al.
5,102,121 A * 4/1992 Solow et al. ..... 482/94
5,302,161 A 4/1994 Loubert et al.
5,656,003 A * 8/1997 Robinson et al. ..... 482/93
6,579,213 B1 6/2003 Webber et al.

FOREIGN PATENT DOCUMENTS

EP 0 597 236 A2 5/1994
FI 874028 9/1987

* cited by examiner

*Primary Examiner*—Loan H Thanh
*Assistant Examiner*—Daniel F Roland
(74) *Attorney, Agent, or Firm*—Merchant & Gould P.C.

(57) ABSTRACT

The invention relates to a multifunctional trainer for strength training. The trainer comprises a body (1), a counterforce unit (2) for generating a counterforce to resist the exercise movements, a set of movement arms ($3^1$, $3^2$) supported to the body (1) for performing different exercise movements, and a set of elongated tensile elements ($4^1$, $4^2$) arranged to act between the counterforce unit (2) and the movement arms ($3^1$, $3^2$) for applying the counterforce resisting each exercise movement from the counterforce unit to the movement arms. The trainer comprises an automatic mechanical coupler (5), to which the tensile elements ($4^1$, $4^2$) are connected, and which coupler is adapted to, immediately at start of each exercise movement, automatically couple the tensile element corresponding to each separate movement arm for said exercise movement, to the counterforce unit (2) in a force-applying manner, for applying the counterforce of the counterforce unit to said exercise movement, without the need for manual connection prior to performing said exercise movement, and without affecting, during said exercise movement, the tensile elements connected to the other movement arms, which are not subject to tension during said exercise movement.

10 Claims, 6 Drawing Sheets

MULTIFUNCTIONAL TRAINER FOR STRENGTH TRAINING

FIELD OF THE INVENTION

Figure 1:
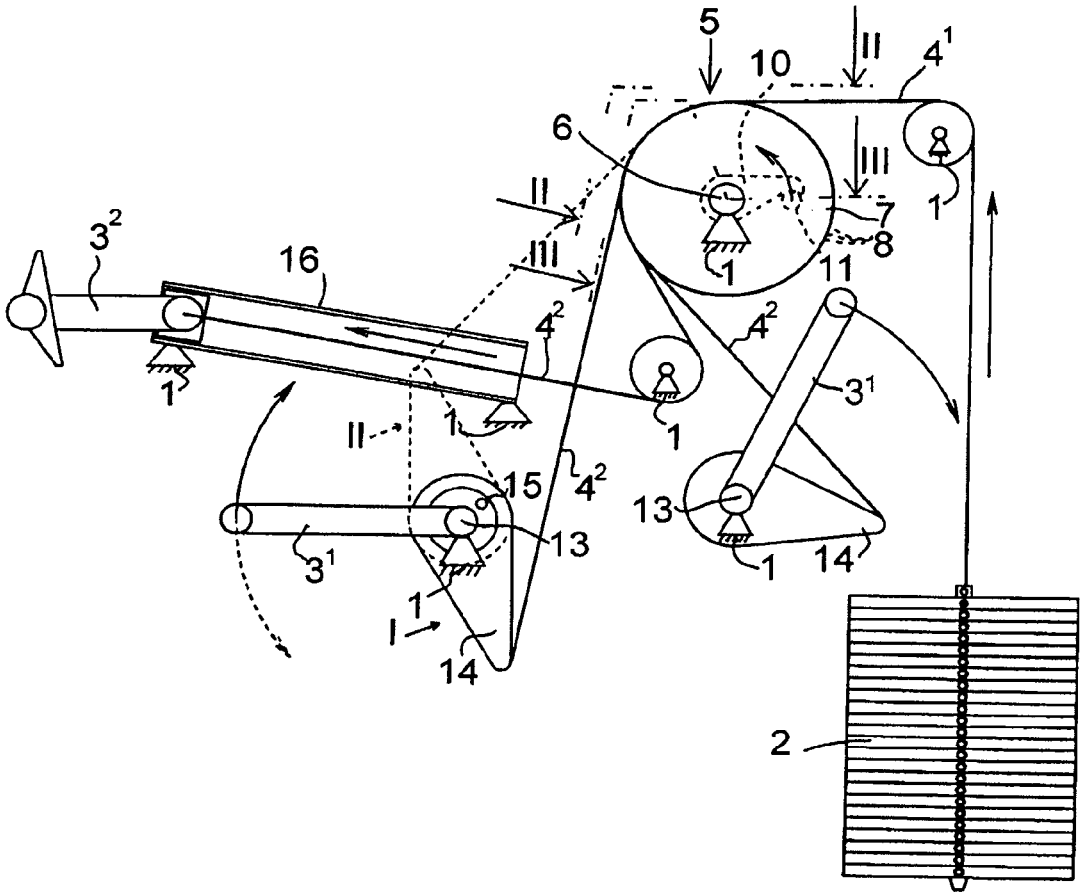

The invention relates to a multifunctional trainer for strength training as defined in the preamble of claim 1.

BACKGROUND OF THE INVENTION

In prior art, multifunctional trainers for strength training are known. These multifunctional trainers have been designed for use in small spaces, such as for home use, where the available space is limited. The known trainers comprise a body. These trainers further comprise a counterforce unit, for example a counterweight or a pneumatic or hydraulic counterforce unit for generating a counterforce to resist the exercise movements. The body holds several different movement, arms so that the user may perform different exercise movements. The counterforce unit and the movement arms are connected by elongated tensile elements for applying the resisting force of the counterforce unit to the movement arms.

The problem with the known multifunctional trainers is that they are large and space-consuming. A further problem is that the elements for applying the resisting force of different movement arms to the counterforce unit comprise pulleys and/or leverage of an extremely complicated structure. The user must switch manually from one function to the other between exercises, which is inconvenient and time-consuming. Long tensile elements and several idlers produce friction and cause insensitivity during training.

OBJECTIVE OF THE INVENTION

The objective of the invention is to eliminate the drawbacks referred to above.

One specific objective of the invention is to disclose a multifunctional trainer as easy to use and as little space-consuming as possible, wherein the user is not forced to switch manually from one function to the other between exercise movements performed with different movement arms.

SUMMARY OF THE INVENTION

The multifunctional trainer in accordance with the invention is characterized by what has been described in claim 1.

In accordance with the invention, the multifunctional trainer comprises an automatic mechanical coupler to which the tensile elements are connected. The coupler is adapted to automatically couple, immediately at start of each exercise movement, the tensile element corresponding to the respective movement arm for performing said exercise movement, to the counterforce unit in a force-applying manner, for applying the counterforce of the counterforce unit to said exercise movement.

The invention has the advantage that, due to the automatic coupler, the user does not need to bother herself with switching prior to performing said exercise movement. In addition, the tensile elements that are not subject to tension during a specific exercise movement are not moved during said exercise movement performed with the appropriate movement arm, thus keeping any other movement arm immobile. Also, the connection between the movement arm and the counterforce unit is as direct, as sensitively bearing-mounted and as frictionless as possible.

In one embodiment of the multifunctional trainer, the coupler comprises a substantially horizontal main axle bearing-mounted rotationally on the body. A resistance pulley is fixedly connected on the main axle, thus rotating as the axle is being rotated. A resistance tensile element is fixedly connected to the resistance pulley at one end, directed over the circumference of the resistance pulley and connected at the other end to the counterforce unit. A set of training pulleys, the number of which substantially corresponds to the number of the movement arms, are freely rotationally bearing-mounted on the main axle at a distance from each other. A set of training tensile elements, the number of which substantially corresponds to the number of the training pulleys, are each fixedly connected at one end to the training pulley, directed over the circumference of the training pulleys and connected at the other end to the movement arm. The coupler also comprises coupling elements for each training pulley for connecting said training pulley to the main axle to rotate the main axle and thus the resistance pulley as said training pulley is being rotated.

In one embodiment of the multifunctional trainer, each of the coupling elements comprise a crank fixedly connected to the main axle, which crank substantially extends perpendicularly outward from the main axle adjacent to the training pulley at one side of it. The couling element also comprises a protruding part extending, at a distance from the main axle, from one side of the training pulley to the movement range of the crank such that the protruding part grabs the crank as the training pulley starts rotating due to movement of the respective movement arm and the training tensile element connected thereto, to rotate the main axle and thus the resistance pulley for applying the resisting force of the counterforce unit to the movement arm.

In one embodiment of the multifunctional trainer, the protruding part is a pin coupled to the training pulley.

In one embodiment of the multifunctional trainer, the mass centre of the training pulley is positioned noncentrally at a distance from the main axle to establish a continuous tension to the training tensile elements. This ensures that the other training pulleys remain immobile during a specific movement and do not rotate with the rotary motion of the main axle.

In one embodiment of the multifunctional trainer, the mass of the protruding part noncentrally offsets the mass centre of the training pulley at a distance from the main axle.

In one embodiment of the multifunctional trainer, the multifunctional trainer comprises a single seat connected to the body and adjacent to it. Several movement arms are arranged in relation to the seat such that the movement arms are within reach of the person sitting on the seat for enabling selective usage of several movement arms while on the same seat.

In one embodiment of the multifunctional trainer, the tensile element is a rope, a cable, a band or the like.

In one embodiment of the multifunctional trainer, the movement arms comprise at least one rotational exercise movement arm bearing-mounted on the body with a rotation axis to which a so called cam is connected. One end of the training tensile element is fixed to the cam at a distance from the rotation axis.

In one embodiment of the multifunctional trainer, the cam is connected to the rotation axis with a locking device, allowing, when in the release position, for the rotation of the cam, in relation to the rotation axis, between the first position and the second position. The cam being set in the first position, the first exercise may be performed. The cam being set in the second position, the second exercise, divergent in relation to the first exercise, may be performed with the same movement arm. When in the stop position, the locking device locks the cam to the first and the second position in relation to the rotation axis. The cam adjusts the weight of the counterforce unit on the movement arm so that it corresponds to the muscular power during each step of the movement range.

In one embodiment of the multifunctional trainer, the movement arms comprise at least one linear movement arm, arranged with a linear guide to move linearly in relation to the body.

In one embodiment of the multifunctional trainer, the counterforce unit is a weight stack, to which one end of the resistance tensile element is connected.

LIST OF FIGURES

Figure 2:
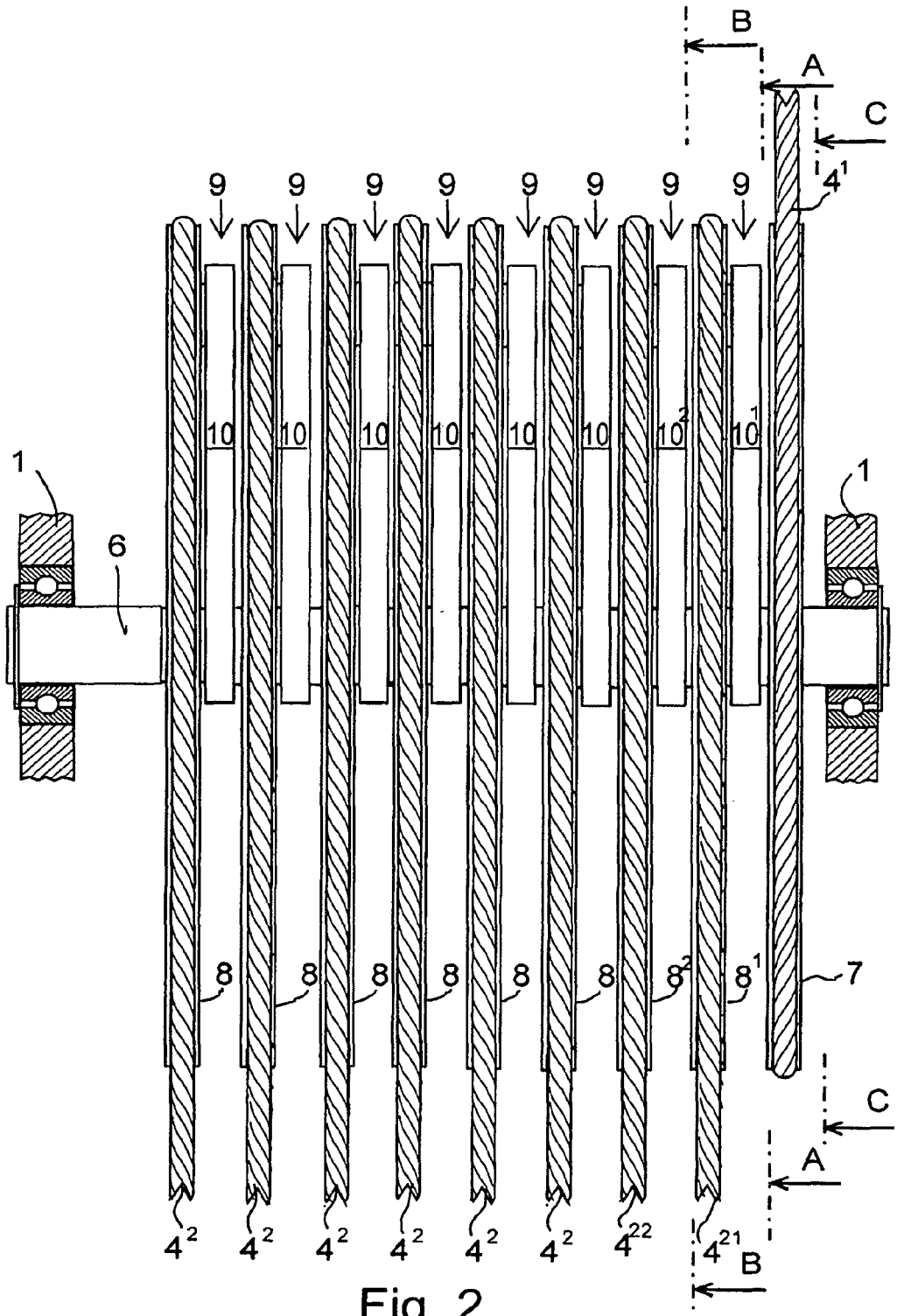
Figure 3:
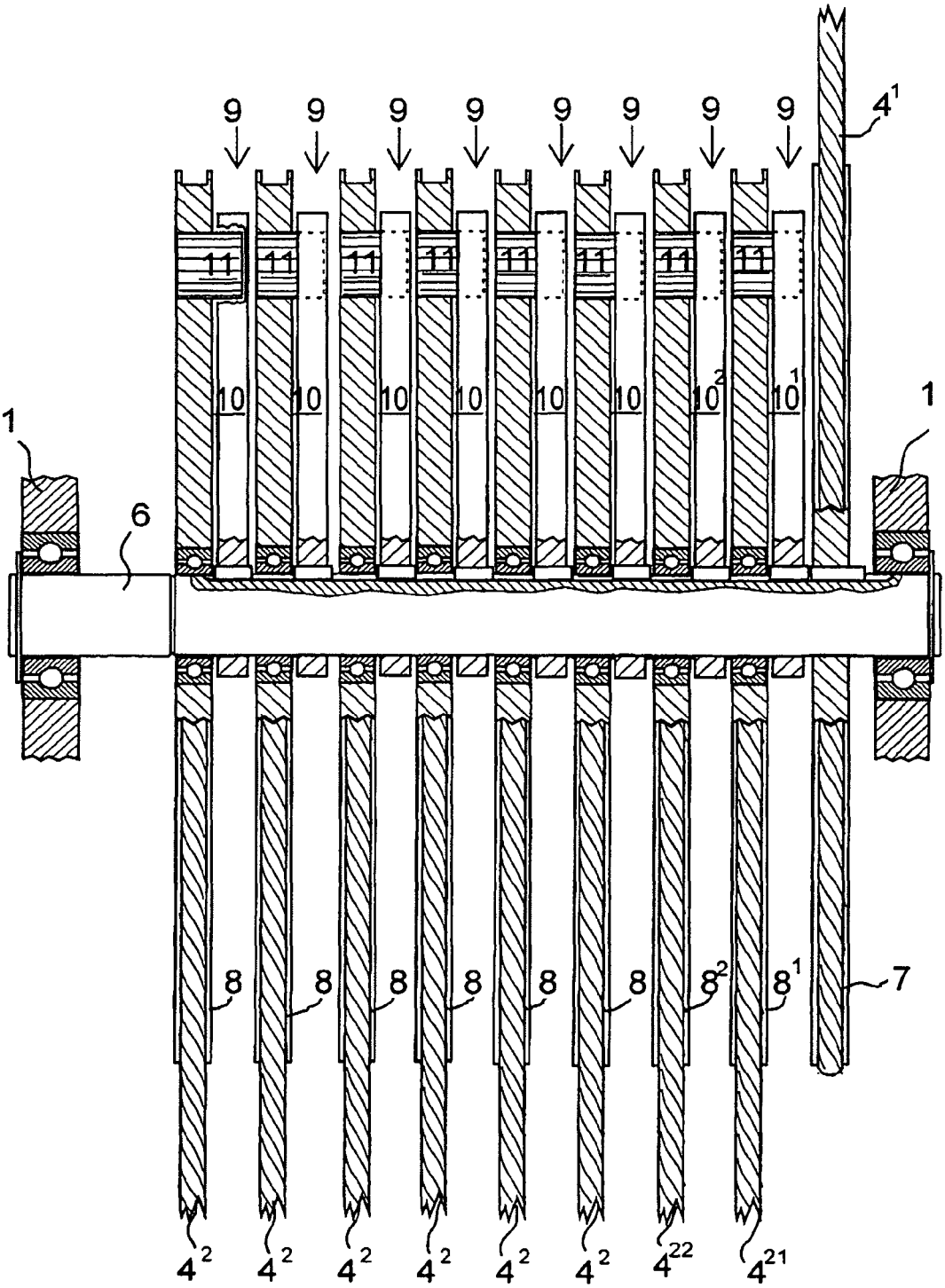
Figure 4:
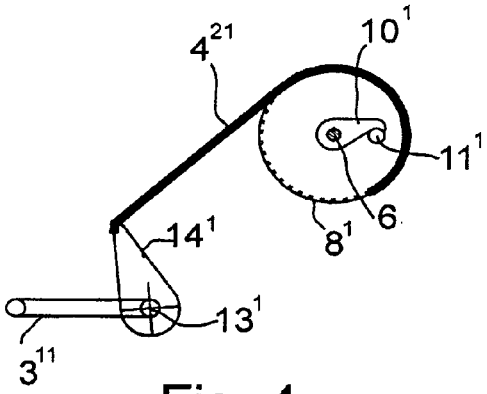
Figure 5:
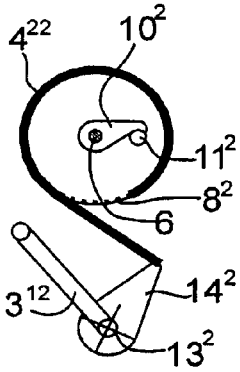
Figure 6:
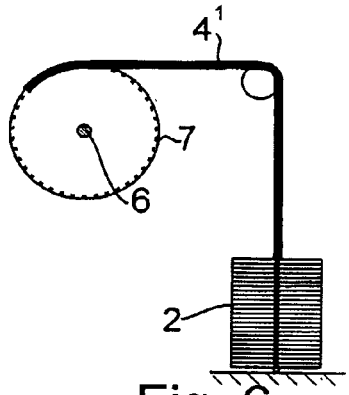
Figure 7:
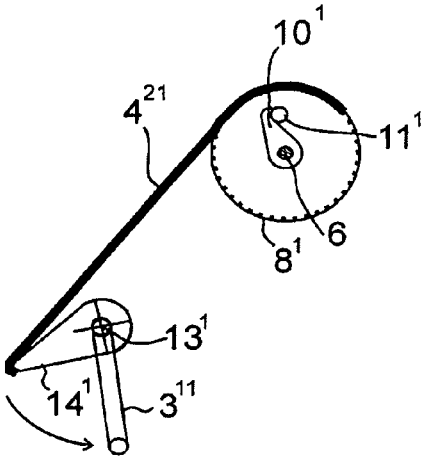
Figure 8:
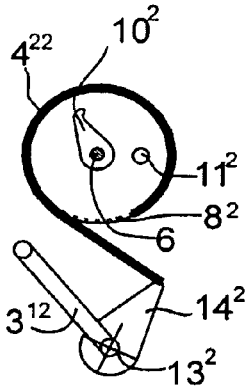
Figure 9:
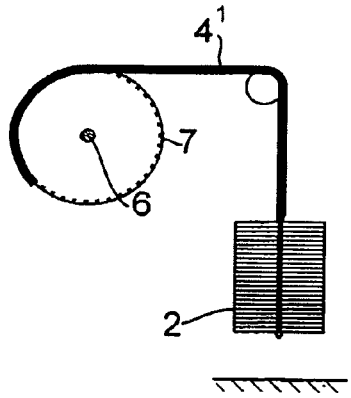
Figure 10:
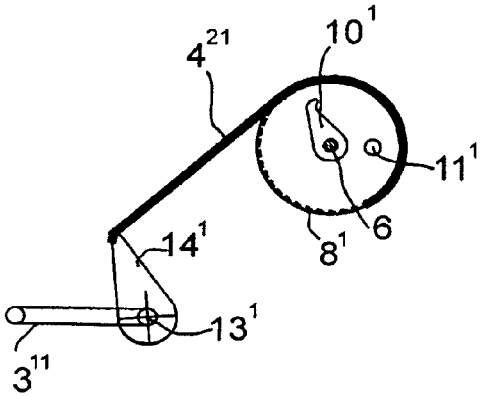
Figure 11:
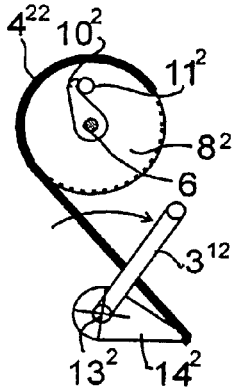
Figure 12:
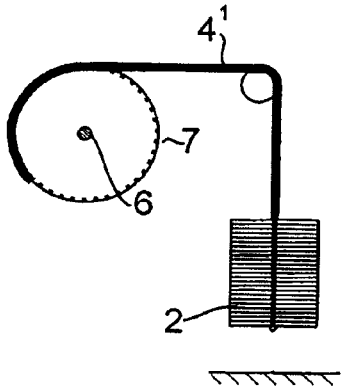
Figure 13:
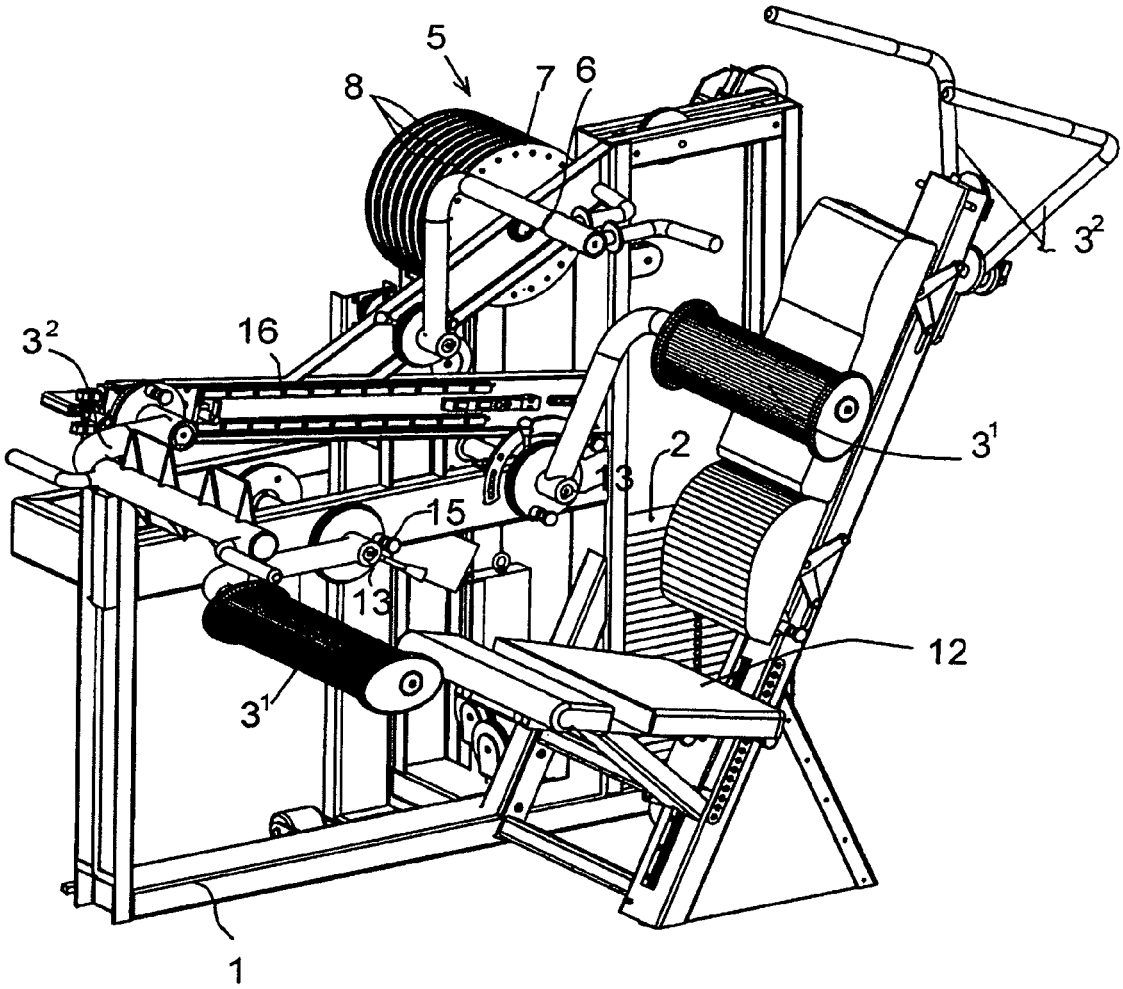
Figure 14:
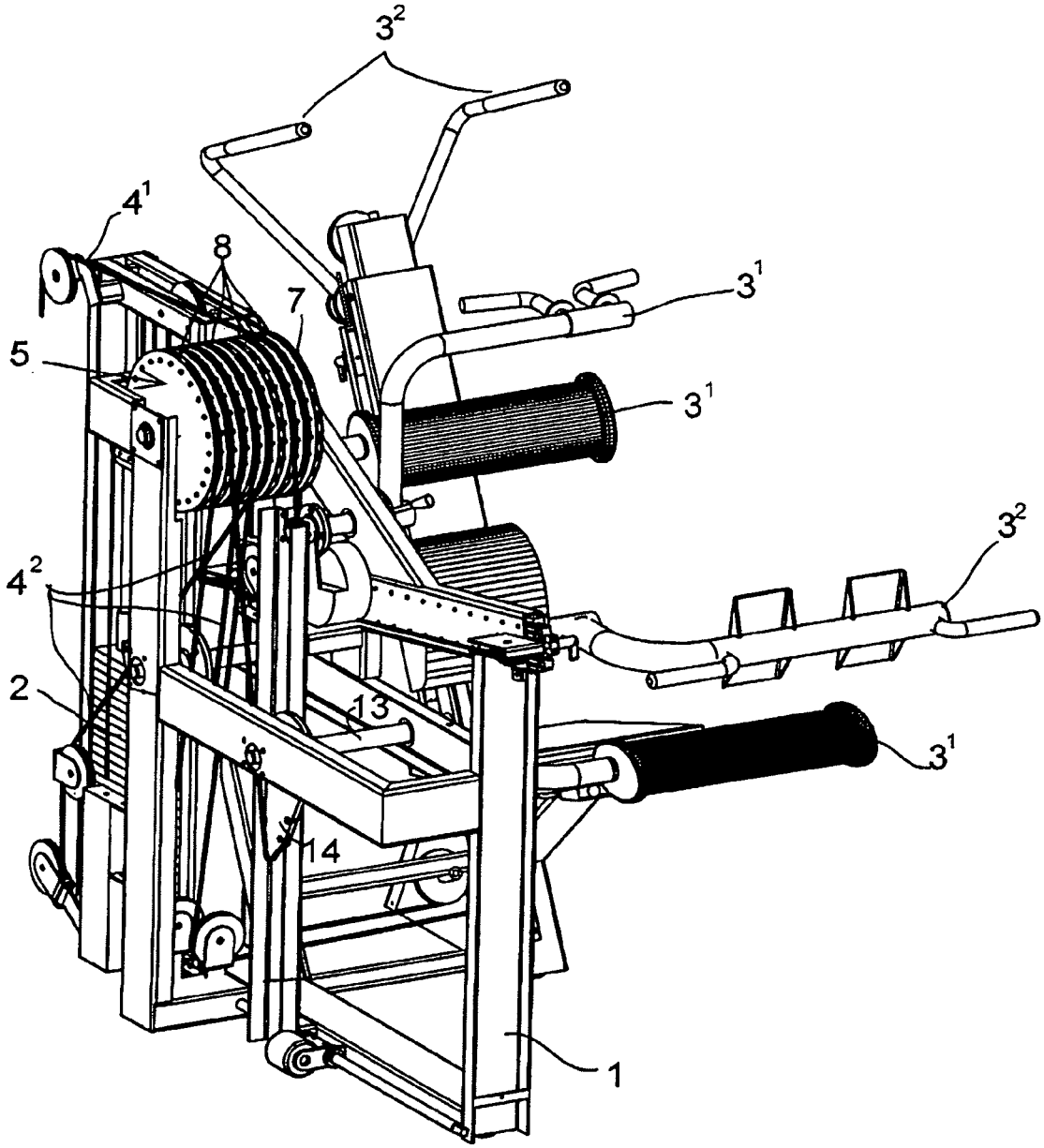

In the following, the invention is described in detail with the aid of exemplary embodiments, with reference to the accompanying drawing, in which FIG. 1 shows a schematic view illustrating the operational principles of one embodiment of the multifunctional trainer according to the invention, FIG. 2 shows a schematic view of the coupler as seen from the direction II-II of FIG. 1, FIG. 3 shows the section III-III of FIG. 1, FIGS. 4, 7 and 10 show the section A-A of FIG. 2 with a movement arm, FIGS. 5, 8 and 11 show the section B-B of FIG. 2 with a movement arm, FIGS. 6, 9 and 12 show the section C-C of FIG. 2 with a movement arm, FIG. 13 shows an axonometric oblique top view of one embodiment of the multifunctional trainer according to the invention, as seen from one direction, and FIG. 14 shows an oblique top view of the multifunctional trainer of FIG. 13 as seen from another direction.

DETAILED DESCRIPTION OF THE INVENTION

FIG. 1 shows a schematic view illustrating the operational principles of the multifunctional trainer of FIGS. 13 and 14 suitable for various strength training exercises.

Referring to FIGS. 1, 13 and 14, the multifunctional trainer comprises a body 1 supported to the floor, with said body holding all elements of the trainer thus forming a compact assembly and requiring only a small space. The exemplary trainer may be used for 20 different strength exercises, and it requires a space of only approximately 2 $m^2$. The multifunctional trainer comprises a single seat 12 coupled to the body 1 and adjacent to it.

The multifunctional trainer comprises a counterforce unit 2 for generating a counterforce to resist the exercise movements. In this example, the counterforce unit 2 is a weight stack to be lifted during each exercise. A set of movement arms $\mathbf{3}^1$, $\mathbf{3}^2$ for different exercise movements are supported to the body 1. The movement arms $\mathbf{3}^1$, $\mathbf{3}^2$ are arranged in relation to the seat 12 such that these movement arms are within reach of the person sitting on the seat, and that several different movement arms may be used while sitting on the same seat.

A set of elongated tensile elements $\mathbf{4}^1$, $\mathbf{4}^2$ are arranged to act between the counterforce unit 2 and the movement arms $\mathbf{3}^1$, $\mathbf{3}^2$ for applying the counterforce resisting each exercise movement from the counterforce unit 2 to the movement arms $\mathbf{3}^1$, $\mathbf{3}^2$. The tensile elements may be ropes, cables, bands, sprocket chains or the like.

FIG. 1 shows, in an exemplary fashion, two rotational exercise movement arms $\mathbf{3}^1$ and one linear movement arm $\mathbf{3}^2$. The rotational exercise movement arms $\mathbf{3}^1$ are bearing-mounted on the body 1 with rotation axes 13. The left rotational movement arm $\mathbf{3}^{11}$ may be used for leg extension or alternatively leg flexion exercises, and the right rotational movement arm $\mathbf{3}^{12}$ may be used for back extension exercises or alternatively abdominal exercises. The linear movement arm $\mathbf{3}^2$ is directed with a linear guide 16 to move linearly in relation to the body 1. The linear movement arm $\mathbf{3}^2$ may be used as a leg press and a chest press or alternatively as a rowing machine.

The trainer comprises an automatic mechanical coupler 5, to which the tensile elements $\mathbf{4}^1$, $\mathbf{4}^2$ are connected. The coupler 5 is adapted to automatically couple, immediately at start of each exercise movement, in a force-applying manner, the tensile element corresponding to the respective movement arm $\mathbf{3}^1$ or $\mathbf{3}^2$ for performing said exercise movement, to the counterforce unit 2, for applying the counterforce of the counterforce unit to said exercise movement.

FIGS. 2 and 3 show in more detail the structure of the mechanical coupler 5. The coupler 5 comprises a substantially horizontal main axle 6 bearing-mounted rotationally on the body 1. A resistance pulley 7, shown on the extreme right in the figure, is fixedly connected, for example with a cotter joint (FIG. 3), to the main axle 6 to rotate with the axis. A resistance tensile element $\mathbf{4}^1$, fixedly connected at one end to the resistance pulley 7 and guided over the circumference of the resistance pulley, is connected, at the other end, to the counterforce unit 2. A set of training pulleys 8 are bearing-mounted freely rotationally on the main axle 6, the number of which training pulleys substantially corresponds to the number of the movement arms 3. The training pulleys 8 are positioned adjacently on the main axle 6 at a distance from each other. Training tensile elements $\mathbf{4}^2$, the number of which corresponds to the number of the training pulleys 8, are fixedly connected at one end to the training pulleys 8, guided over the circumference of the training pulleys 8 and connected at the other end to the cam 14, which is fixedly connected to the movement arm $\mathbf{3}^1$, and, during linear movements, the other end of the training tensile element is in a locking element, which may be removably coupled to the movement arm $\mathbf{3}^2$. Each training pulley 8 has a corresponding coupling element 9, which connects the training pulley 8 to the main axle 6 as said training pulley 8 is being rotated.

Still referring to FIG. 1, the cam 14 is preferably connected to the rotation axis 13 with a locking device 15. The locking device 15 being at the release position, the cam 14 may be rotated in relation to the rotation axis between the first position I and the second position II. When in the first position I, the movement arm may be used for the first exercise. When in the second position II, the same movement arm may be used for the second exercise, divergent in relation to the first exercise. The locking device 15 being at the stop position, the cam 14 is locked to the first and to the second position I, II in relation to the rotation axis 13.

FIGS. 3-12 show the structure and operation of the coupling element 9. Each coupling element 9 comprises a crank 10, fixedly connected to the main axle 6, for example with a cotter joint, as shown in FIG. 3. The crank 10 extends substantially perpendicularly outward from the main axle 6 adjacent to the training pulley 8 on one side of it. The coupling element 9 further comprises a protruding part 11, which extends, at a distance from the main axle 6, from one side of the training pulley 8 to the movement range of the crank 10 such that the protruding part 11 grabs the crank 10 as the training pulley 8 starts rotating due to movement of the respective movement arm $\mathbf{3}^1$ or $\mathbf{3}^2$ and the training tensile element $\mathbf{4}^2$ connected thereto. Since the crank 10 is fitted to the main axle 6, the resistance pulley 7 rotates with it, thus applying the resisting force of the counterforce unit 2 to the movement arm $3^1$ or $3^2$ that is moved during each specific exercise. The protruding part 11 of the training pulley 8 is a pin coupled to the training pulley 8. Preferably, the mass centre of the training pulley 8 is positioned noncentrally at a distance from the main axle 6 to form a continuous tension to the training tensile elements $4^2$ and to keep immobile the training pulleys 8 not used for the exercise. The mass of the protruding part 11 is preferably used to noncentrally shift the mass centre of the training pulley 8 at a distance from the main axle 6.

FIG. 4 shows the first training pulley $8^1$ bearing-mounted freely on the main axle 6, to the circumference of which pulley the first training tensile element $4^{21}$ is coupled, the training tensile element being connected at one end to the cam $14^1$ of the first rotational exercise movement arm $3^{11}$. FIG. 5 shows the second training pulley $8^2$, bearing-mounted freely on the same main axle 6, to the circumference of which pulley the second training tensile element $4^{22}$ is fixedly connected, the training tensile element being at one end connected to the cam $14^2$ of the first rotational exercise movement arm $3^{12}$. FIG. 6 shows the resistance pulley 7 on the same main axle, to the circumference of which the resistance tensile element $4^1$ is coupled, the resistance tensile element being at one end coupled to the counterforce unit 2. In FIGS. 4-6, the multifunctional trainer is in an unoperational state, in which the movement arms have not been moved. The weight stack 2 is positioned on the platform.

FIGS. 7-9 show a situation in which an exercise movement has been performed using the first rotational exercise movement arm $3^{11}$, in which case the first training tensile element $4^{21}$ rotates the first training pulley $8^1$ counterclockwise. At the same time, the pin $11^1$ coupled to the first training pulley $8^1$ grabs the crank $10^1$ coupled to the main axle 6, thus rotating the main axle 6 and the resistance pulley 7, which activates the resistance tensile element $4^1$, the rotation of which results in lifting of the weight stack 2. FIG. 8 shows that the second training pulley $8^2$ bearing-mounted freely and rotationally on the main axle 6 rests immobile. The weight of the pin $11^2$ further contributes to the immobility.

FIGS. 10-12 show a situation in which an exercise movement has been performed using the second rotational exercise movement arm $3^{12}$, in which case the second training tensile element $4^{22}$ rotates the second training pulley $8^2$. At the same time, the pin $11^2$ coupled to the second training pulley $8^2$ grabs the crank $10^2$ coupled to the main axle, thus rotating the main axle 6 and the resistance pulley 7, which activates the resistance tensile element $4^1$, the rotation of which results in lifting of the weight stack 2. FIG. 10 shows that the first training pulley $8^1$, bearing-mounted freely and rotationally on the main axle 6 rests immobile. The weight of the pin $11^2$ further contributes to the immobility.

The invention is not limited merely to the exemplary embodiments referred to above, instead many variations are possible within the scope of the inventive idea defined by the claims.

The invention claimed is:

1. A multifunctional trainer for strength training, the trainer comprising a body, a counterforce unit for generating a counterforce to resist exercise movements, a set of movement arms supported to the body, for performing different exercise movements, a set of elongated tensile elements arranged to act between the counterforce unit and the movement arms to apply the counterforce resisting each exercise movement from the counterforce unit to the movement arms, wherein the trainer comprises an automatic mechanical coupler, to which the tensile elements are connected, and wherein the coupler is adapted to, immediately at start of each exercise movement, automatically couple the tensile element corresponding to each separate movement arm for said exercise movement, to the counterforce unit in a force-applying manner, for applying the counterforce of the counterforce unit to said exercise movement, without the need for manual connection prior to performing said exercise movement, and without affecting, during said exercise movement, the tensile elements connected to the other movement arms, which are not subject to tension during said exercise movement, wherein the coupler comprises a substantially horizontal main axle, bearing-mounted rotationally on the body, a resistance pulley fixedly connected on the main axle to rotate with it, a resistance tensile element fixedly connected at one end to the resistance pulley, directed over the circumference of the resistance pulley, and connected, at the other end, to the counterforce unit, a set of training pulleys, the number of which substantially corresponds to the number of the movement arms, which training pulleys are freely rotationally bearing-mounted on the main axle at a distance from each other, a set of training tensile elements, the number of which substantially corresponds to the number of the training pulleys, each training tensile element being fixedly connected at one end to the training pulley, directed over the circumference of the training pulley, and connected, at the other end, to the movement arm, and a set of coupling elements for each training pulley for coupling said training pulley to the main axle to rotate the main axle and thus the resistance pulley, as said training pulley is being rotated, wherein each of the coupling elements comprises a crank, fixedly connected to the main axle, wherein the crank extends substantially perpendicularly outwards from the main axle adjacent to the training pulley on one side of it, and a protruding part, extending, at a distance from the main axle, from one side of the training pulley to the movement range of the crank, such that the protruding part grabs the crank as the training pulley starts rotating due to movement of the respective movement arm and the training tensile element connected thereto, for rotating the main axle and thus the resistance pulley such that the counterforce of the counterforce unit is applied to the movement arm.

2. The multifunctional trainer according to claim 1, wherein the protruding part is a pin fixedly connected to the training pulley.

3. The multifunctional trainer according to claim 2, wherein the mass center of the training pulley is positioned noncentrally at a distance from the main axle to form a continuous tension to the training tensile elements.

4. The multifunctional trainer according to claim 2, wherein the mass of the protruding part noncentrally moves the mass center of the training pulley at a distance from the main axle.

5. The multifunctional trainer according to claim 1, wherein the multifunctional trainer comprises a single seat, connected to the body next to it, and in that several movement arms are arranged in relation to the seat such that the movement arms are within reach of the person sitting on the seat so that several movement arms may be selectively used while on the same seat.

6. The multifunctional trainer according to claim 1, wherein the tensile element is a rope, a cable, or a ribbon.

7. The multifunctional trainer according to claim 1, wherein the movement arms comprise at least one rotational exercise movement arm, bearing-mounted on the body with a rotation axis, to which a so called cam is connected for adjusting the weight load of the counterforce unit to the movement arm to correspond to the muscle strength at each step of the movement range, with one end of the training tensile element being connected to said cam at a distance from the rotation axis.

8. The multifunctional trainer according to claim 7, wherein the cam is connected to the rotation axis with a locking device, which, when in the release position, enables the rotation of the cam, in relation to the rotation axis, from the first position (I) for using the movement arm for the first exercise, to the second position (II) for using the same movement arm for the second exercise, divergent in relation to the first exercise, and which locking device, when in the stop position, locks the cam to the first and to the second position in relation to the rotation axis.

9. The multifunctional trainer according to claim 1, wherein the movement arms comprise at least one linear movement arm, arranged with a linear guide to move linearly in relation to the body.

10. The multifunctional trainer according to claim 1, wherein the counterforce unit is a weight stack, to which one end of the resistance tensile element is connected.

* * * * *